United States Patent [19]

Pogoda

[11] 4,338,846

[45] Jul. 13, 1982

[54] REMOTE CONTROL FOR ELECTRONIC MUSICAL INSTRUMENT EQUIPMENT

[76] Inventor: Gary S. Pogoda, 223 N. Douglass Ave., Margate, N.J. 08402

[21] Appl. No.: 128,268

[22] Filed: Mar. 7, 1980

[51] Int. Cl.[3] ..... G10H 1/02

[52] U.S. Cl. ..... 84/1.24; 84/454; 84/DIG. 18; 84/1.16

[58] Field of Search ..... 84/1.16, 1.01, 1.24, 84/454, DIG. 18; 307/114; 340/171 R; 455/68, 207

[56] References Cited

U.S. PATENT DOCUMENTS 3,871,247 3/1975 Bonham ..... 84/1.16

3,896,697 7/1975 Iannone ..... 84/1.16

4,184,118 1/1980 Cannalte et al. ..... 340/171 R

*Primary Examiner*—J. V. Truhe

*Assistant Examiner*—Forester W. Isen

*Attorney, Agent, or Firm*—Duffield & Lehrer

[57] ABSTRACT

A manually operated switch located on an electric guitar controls a remotely located tuning device through the existing guitar cable. Preferably, the switch is located in an adaptor which plugs into the audio output jack of the guitar and into which is plugged the guitar cable. Circuitry associated with the switch sends a control signal on the audio cable and circuitry located adjacent the tuner interprets the control signal for controlling the tuner.

2 Claims, 5 Drawing Figures

REMOTE CONTROL FOR ELECTRONIC MUSICAL INSTRUMENT EQUIPMENT

BACKGROUND OF THE INVENTION

The present invention is directed toward a device for the remote control of electronic musical instrument equipment and more particularly toward a device which is primarily intended to remotely control an electronic tuning circuit.

Numerous electronic tuning devices have been proposed which are intended to aid a musician in the tuning of a stringed instrument such as a guitar. Many of these proposed devices include a microphone or pickup for converting the sound produced by a vibrating string into an electronic signal. This signal is then compared with a signal from a frequency generator which is selected to be equal to the frequency of the string being tuned. These prior devices include numerous different techniques for indicating when the comparator senses that the frequency of the string is equal to the frequency of the frequency generator. Examples of this type of tuning device are shown in U.S. Pat. Nos. 3,766,818; 3,861,266 and 3,901,120. In an effort to improve the accuracy of electronic tuning devices such as those described above and to simplify the operation thereof, Applicant has proposed to connect the tuning device directly in line with the audio cable leading from the guitar pickup to the guitar amplifier. Thus, rather than requiring a separate microphone for the tuner, the audio signal representing the frequency of the vibrating string is taken directly from the audio cable.

This technique, proposed by Applicant, does however create an additional problem. That is, the amplifier is quite often located at a remote location from the guitar and accordingly it would be extremely inconvenient if not impossible for the musician desiring to tune his guitar to control the tuner. In other words, each time the musician wished to tune a different string on his guitar he would have to walk some distance to the tuning device to turn a switch which would control the output frequency of the frequency generator therein. This, of course, cannot possibly be done during a performance although it is quite often necessary to tune or at least check the tuning of a guitar at that time.

SUMMARY OF THE INVENTION

The present invention is designed to overcome the foregoing described problem. This is accomplished by a manually operated switch located on the electric guitar which controls a remotely located tuning device through the existing guitar cable. Preferably, the switch is located in an adaptor which plugs into the audio output jack of the guitar and into which is plugged the guitar cable. Circuitry associated with the switch sends a control signal on the audio cable and circuitry located adjacent the tuner interprets the control signal for controlling the tuner. It is also contemplated that the present invention may be utilized with other types of audio equipment such as a microphone or the like instead of a guitar and may be used for controlling equipment such as an amplifier or the like. In this regard, the control circuit may be utilized for remotely controlling the volume of the amplifier.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
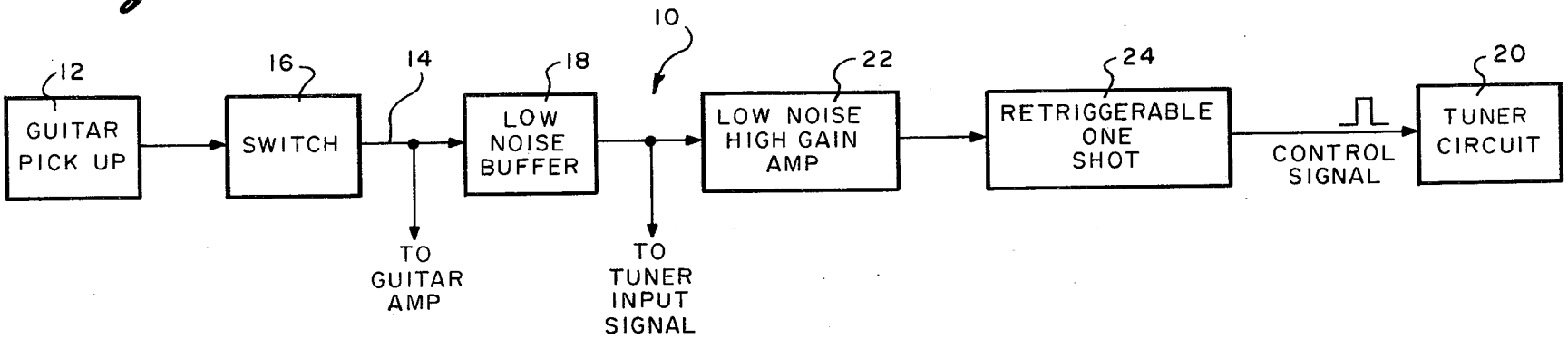
FIG. 1 is a block diagram schematic representation of a remote control circuit for electronic musical instrument equipment constructed in accordance with the principles of the present invention.

Referring now to the drawings in detail wherein like reference numerals have been used throughout the various figures to designate like elements, there is shown in FIG. 1 a schematic representation of a remote control circuit for controlling electronic musical instrument equipment and designated generally as 10. The circuit 10 utilizes the existing guitar pickup 12 which, as is well known in the art, is a mechanical to electrical transducer. The output of the guitar pickup 12 is normally connected to the guitar amplifier through an audio cable 14. In accordance with the present invention, however, a switch 16 preferably carried by the guitar is connected in the audio cable line.

The audio cable 14 continues on and is connected to a remotely located guitar amplifier (not shown) in the conventional manner. Located adjacent the guitar amplifier and remote from the guitar is a low-noise buffer 18. Buffer 18 isolates the rest of the circuit from the guitar amplifier to prevent signals from the remaining parts of the circuit from feeding back into the amplifier or from loading the amplifier. The output of the low-noise buffer 18 is connected to the audio input of a tuner circuit 20.

The output of low-noise buffer 18 is also connected to the input of a low-noise, high-gain amplifier circuit 22. Following the low-noise amplifier 22 is a retriggerable one shot 24 which has its output, in turn, connected to the control input of the tuner circuit 20. Tuner circuit 20 is of the type which has a frequency generator therein capable of selectively generating one of a number of preselected frequencies. The particular frequency generated is selected by a counter at the input of the tuner circuit which is responsive to the control signal from the retriggerable one shot 24. Such a tuner circuit is shown, for example, in FIG. 9 of Applicant's co-pending application Ser. No. 120,061, now U.S. Pat. No. 4,320,689, filed Feb. 11, 1980.

Figure 5:
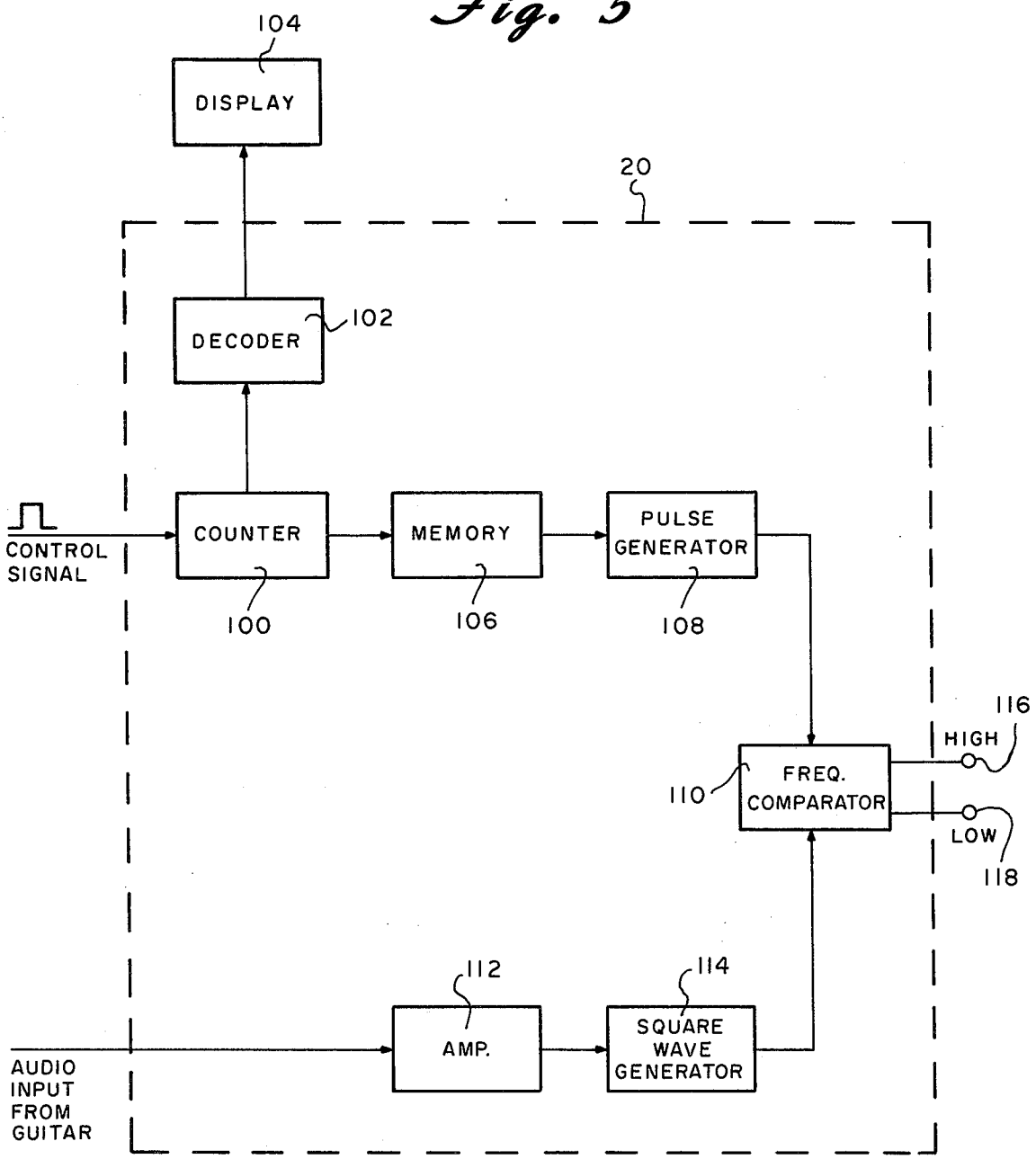
FIG. 5 is a schematic representation of a tuner circuit which may be utilized with the present invention.

The tuner circuit which is more fully described in Applicant's co-pending application is illustrated in present FIG. 5 and is comprised of a counter 100 having its input connected to the output of the retriggerable one shot 24. Thus, for each pulse of the control signal, counter 100 is incremented. The count is decoded by decoder 102 which is connected to a seven-segment display 104. The display 104 will display, for example, one of the letters "E," "A," "D," "G" or "B" representing the strings of a guitar depending on the number of pulses from the retriggerable one shot 24 which, of course, is also equal to the number of times that the switch 16 is depressed.

Counter 100 is also connected to a memory such as a ROM 106 which will then cause the pulse generator 108 to generate the appropriate frequency corresponding to the frequency of the string represented by the letter displayed by the display 104. The output of the pulse generator 108 is also connected to one side of the frequency comparator 110.

The tuner circuit 20 also includes an amplifier 112 which has its input connected to the audio signal from the guitar which, in FIG. 1, is the output of the low noise buffer 18 as illustrated. The output of amplifier 112 is converted to a pulse form by square wave generator 114. Frequency comparator 110 compares the output of the pulse generator 108 which is the desired frequency to the output of the square wave generator 114 which represents the actual frequency of the vibrating string. If the frequency of the vibrating string is too high, diode 116 is energized and if the frequency of the vibrating string is too low, diode 118 is energized. As is known in the art, the tension on the string is then adjusted until it is brought into tune.

The circuit shown in FIG. 1 operates in the following manner. Switch 16 is preferably a momentary contact switch which, when depressed, disconnects the guitar pickup output from the audio cable leading to the guitar amplifier and the remaining parts of the circuit. This may be done either by simply opening the circuit between the guitar pickup 12 and the cable 14, by simply shorting or grounding the audio cable 14 or by a combination thereof, i.e. by shorting the audio cable while simultaneously disconnecting the guitar pickup.

Regardless of the particular manner of operation of switch 16, there will be an absence of any significant audio signal or noise level in audio cable 14 whenever switch 16 is depressed. The noise referred to is normally present on line 14 and is a result of the normal output of the pickup 12 even when the guitar is not being played. When there is audio signal or noise on the line 14, it will be amplified by high-gain amplifier 22. However, when the switch 16 is depressed, the output of amplifier 22 will go low. Retriggerable one shot 24 is responsive to the output of amplifier 22 so as to be continuously retriggered by the presence of any noise or audio signal level and will alternatively generate a pulse or control signal each time the switch 16 is depressed and the noise or audio signal is removed. This control signal is utilized to select the desired frequency within the tuner circuit 20.

Figure 2:
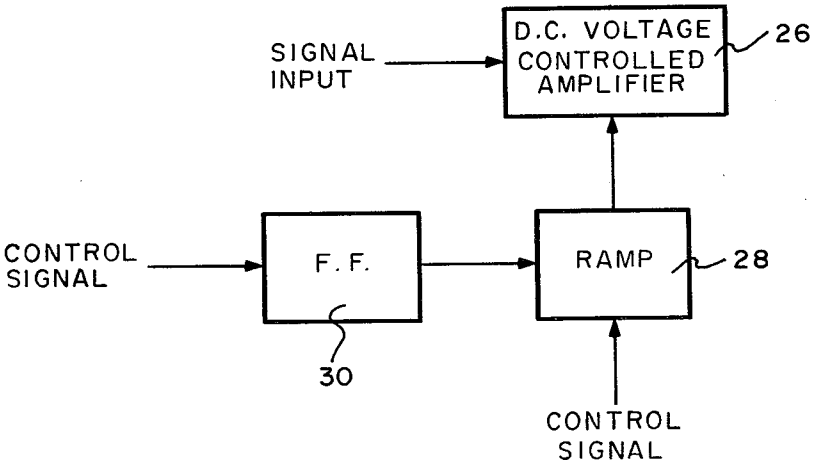
FIG. 2 is a schematic representation of a circuit for controlling the volume of a remotely located amplifier utilizing the basic circuit shown in FIG. 1.

FIG. 2 illustrates the manner that the circuit shown in FIG. 1 may be utilized to control the volume of an amplifier. This is accomplished by utilizing a DC voltage-controlled amplifier 26. The amplification factor of amplifier 26 is controlled by ramp circuit 28 in a known manner. The ramp duration is controlled by the control signal coming from the output of retriggerable one shot 24. Ramp circuit 28 is therefore controlled by depressing switch 16. Holding switch 16 depressed increases the pulse width of the control signal which in turn controls the ramp duration and thus the volume of amplifier 26.

It would, of course, also be desirable to decrease the amplification factor of amplifier 26 and to again increase the same if needed. This can be accomplished by also controlling the direction of the ramp in ramp circuit 28. To accomplish this, the control signal from the output of retriggerable one shot 24 is also fed to a flip-flop 30 which, in turn, is connected to the ramp direction input of the ramp circuit 28. Thus, each time switch 16 is depressed the direction of the ramp in ramp circuit 28 and therefore the direction of the amplifier (increase or decrease) volume also changes. It may also be desirable to include a visual indicator to distinguish when the volume of the amplifier 26 is being increased or decreased.

The switch 16 may be built directly into the guitar. However, substantially all electric guitars are equipped with a standard phone jack into which is plugged a standard phone plug from the audio cable leading to the guitar amplifier. Shown diagrammatically in FIG. 3 is an adaptor 32 which may be used in line between the guitar and the audio cable and which includes a switch which will function as switch 16.

Adaptor 32 includes a forward standard phono plug portion 34 which is adapted to be plugged directly into an electric guitar. The rear portion of the adaptor 32 includes a socket portion 36 which is adapted to accept a standard phono plug 38 at the end of a standard audio cable 40 leading to the guitar amplifier and associated circuitry. The adaptor 32 carries a momentary push-button switch 42 which, as shown schematically, shorts or grounds the jack 36 and thus, as explained above, eliminates the noise signal on the audio cable 40.

Figure 3:
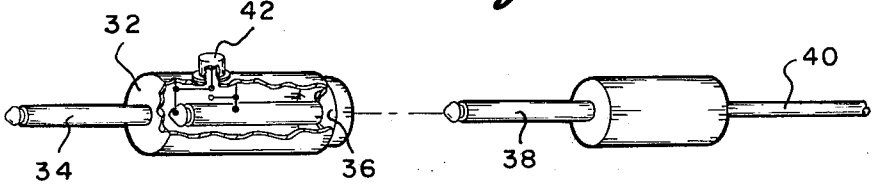
FIG. 3 is a diagrammatic representation of a combined control switch and adaptor which may be utilized with the present invention.

By utilizing the adaptor 32 shown in FIG. 3, no modifications need be made to the guitar. All that is necessary is that the adaptor 32 be plugged into the existing phono jack in the guitar and the audio cable leading to the amplifier then be plugged into the adaptor. The switch 42 on the adaptor may then be used as switch 16 in the circuitry described above.

Figure 4:
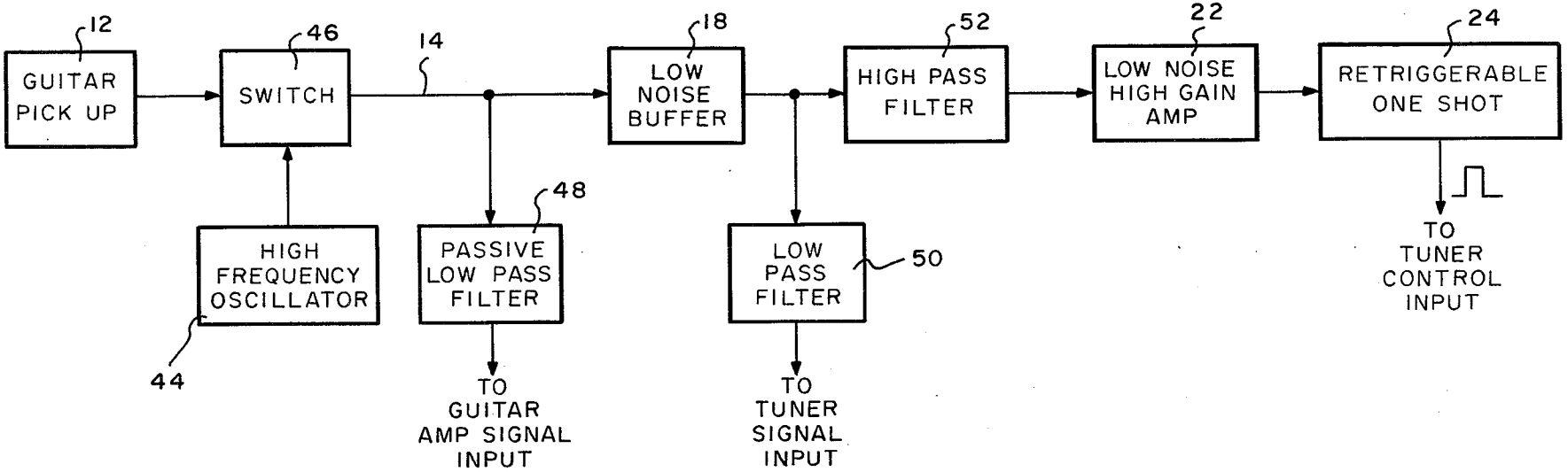
FIG. 4 is a schematic representation of a second embodiment of the present invention.

Another embodiment of the control circuitry of the present invention is shown in FIG. 4. In this embodiment, a signal source other than the audio signal or noise (or absence of such) is utilized as the control signal. This other signal is supplied by a high frequency oscillator 44. The frequency of the oscillator 44 should be somewhat above the frequencies normally encountered with an electric guitar and associated audio equipment.

When switch 46 (which may be similar to switch 16) is depressed, the output of the high frequency oscillator 44 is delivered to the audio cable 14. Passive low pass filter 48 and low pass filter 50 prevent the signal from the high frequency oscillator 44 from passing to the guitar amplifier or to the tuner input. High pass filter 52 prevents the audio signal or noise from the guitar from passing to the retriggerable one shot 24. High pass filter 52, however, does allow the output of the high frequency oscillator 44 to pass to the high-gain amplifier 22 which controls the retriggerable one shot 24 in the same manner as the audio signal or noise described above with respect to FIG. 1.

From the foregoing descriptions, it should be readily apparent that the present invention allows for the control of remotely located audio equipment such as an amplifier or a tuner device utilizing the existing audio cable. The only modification which need be made to the guitar (or other device such as a microphone or the like) is the inclusion of a switch or with respect to FIG. 4 a switch and a high frequency oscillator. When the adaptor shown in FIG. 3 is utilized, the "modifications" to the guitar are easily performed. All of the rest of the control circuitry shown in the figures is located remote from the guitar and adjacent the audio equipment being controlled and the only connection between the two is the existing audio line.

The present invention may be embodied in other specific forms without departing from the spirit or essential attributes thereof and accordingly, reference should be made to the appended claims rather than to the foregoing specification as indicating the scope of the invention.

I claim:

1. In an electronic musical instrument system including a musical instrument having an output jack, a remotely located audio device and an audio cable for carrying an audio signal from said instrument to said remotely located audio device, said cable having a plug adapted to be plugged into said output jack, the improvement comprising:

a switch housing, said housing including a plug adapted to be plugged into said output jack of said musical instrument, said housing also having a jack adapted to be connected to the plug of said audio cable and circuit means within said housing electrically connecting said housing plug to said housing jack, and a manually operable momentary contact switch carried by said housing, said switch being adapted to short said circuit means when depressed to thereby electrically short said audio cable;

an additional circuit means located adjacent said remotely located audio device including means for sensing when said switch is depressed and means for controlling said audio device in response to said sensing means.

2. The invention of claim 1 wherein said audio device includes a musical instrument tuning circuit having a frequency generator circuit means therein capable of selectively generating a plurality of predetermined audio frequencies and wherein said control means selects the frequency to be generated by said tuning circuit.

* * * * *